US008754773B1

(12) United States Patent
Von Gunten

(10) Patent No.: US 8,754,773 B1
(45) Date of Patent: Jun. 17, 2014

(54) DEVICE FOR SIMULATING HUMAN ACTIVITY IN AN UNOCCUPIED DWELLING

(76) Inventor: Lee Von Gunten, West Jordan, UT (US)

( * ) Notice: Subject to any disclaimer, the term of this patent is extended or adjusted under 35 U.S.C. 154(b) by 20 days.

(21) Appl. No.: 10/906,489

(22) Filed: Feb. 22, 2005

Related U.S. Application Data

(60) Provisional application No. 60/521,104, filed on Feb. 21, 2004.

(51) Int. Cl.
*G08B 17/00* (2006.01)

(52) U.S. Cl.
USPC ... 340/584; 340/583; 340/309.16; 340/309.7; 340/309.8; 340/309.9; 340/393.4

(58) Field of Classification Search
CPC ..... G08B 17/06; G08B 17/00; G08B 21/182; G08B 19/02; B64D 15/20
USPC ..... 340/584, 588, 309.9, 309.16, 309.3, 340/309.4, 655, 656, 583, 309.7, 309.8, 340/393.4; 368/10, 107; 374/1, 100, 102, 374/113; 393/393
See application file for complete search history.

(56) References Cited

U.S. PATENT DOCUMENTS

| | | | | | |
|---|---|---|---|---|---|
| 1,473,057 | A | | 11/1923 | Stern | 315/313 |
| 2,659,787 | A | | 11/1953 | Prickett | 200/13 |
| 3,426,306 | A | | 2/1969 | Scheid, III et al. | 337/14 |
| 3,781,566 | A | * | 12/1973 | Meuller | 307/116 |
| 3,953,817 | A | | 4/1976 | Covert | 337/136 |
| 3,997,742 | A | | 12/1976 | Marquis | 200/38 |
| 4,001,527 | A | | 1/1977 | Hulshizer | 200/38 |
| 4,060,123 | A | * | 11/1977 | Hoffman et al. | 165/11.1 |
| 4,307,303 | A | | 12/1981 | Chiu | 307/141 |
| 4,323,762 | A | * | 4/1982 | Ervin et al. | 219/482 |
| 4,367,416 | A | * | 1/1983 | Von Gunten | 307/132 R |
| 4,414,525 | A | | 11/1983 | Garrabrants | 337/92 |
| 4,494,012 | A | | 1/1985 | Coker | 307/132 |
| 5,258,656 | A | * | 11/1993 | Pawlick | 307/141 |
| 5,600,306 | A | * | 2/1997 | Ichikawa et al. | 340/584 |
| 5,715,214 | A | | 2/1998 | Svarnias | 368/10 |
| 5,835,001 | A | * | 11/1998 | Hofsass | 337/104 |
| 5,998,763 | A | * | 12/1999 | Mattis et al. | 219/265 |
| 6,054,916 | A | * | 4/2000 | Hofsass | 337/344 |
| 6,057,529 | A | * | 5/2000 | Kirby | 219/445.1 |
| 6,121,889 | A | | 9/2000 | Janda et al. | 340/815 |
| 6,167,000 | A | * | 12/2000 | Chow | 368/107 |
| 6,295,003 | B1 | * | 9/2001 | Wu | 340/664 |
| 6,307,812 | B1 | * | 10/2001 | Gzybowski et al. | 368/10 |
| 6,448,883 | B1 | * | 9/2002 | Hofsass | 337/373 |
| 6,557,353 | B1 | * | 5/2003 | Fusco et al. | 62/3.2 |
| 6,601,983 | B1 | * | 8/2003 | Runfola et al. | 362/545 |
| 6,773,679 | B2 | * | 8/2004 | Jaworski et al. | 422/123 |
| 6,903,284 | B2 | * | 6/2005 | Dunfield et al. | 200/51 R |
| 2005/0091995 | A1 | * | 5/2005 | Kim | 62/126 |

* cited by examiner

*Primary Examiner* — Benjamin C Lee
*Assistant Examiner* — Quang D Pham
(74) *Attorney, Agent, or Firm* — Geoffrey E. Dobbin; Dobbin IP Law P.C.

(57) ABSTRACT

The present invention is a thermally activated electrical switch for use in simulating human activity. The invention is features dual heat sources enclosed in a thermally isolated chamber within the invention. Since the activation of the switch is dependent upon the ambient temperature of the environment, it opens and closes at sufficiently random intervals to simulate human activity. Other embodiments include the use of photoelectric sensors and timers to further vary timing of the switch actuation.

16 Claims, 4 Drawing Sheets

DEVICE FOR SIMULATING HUMAN ACTIVITY IN AN UNOCCUPIED DWELLING

CROSS-REFERENCES TO RELATED APPLICATIONS AND PATENTS

This Application claims priority based on prior Provisional Application No. 60/521,104, filed Feb. 21, 2004, which is incorporated by reference.

FIELD OF THE INVENTION

The present invention relates to the field of electrical security timers and more particularly relates to a randomized timer that is thermally operated.

BACKGROUND OF THE INVENTION

Over the past 40 years, consumers, for the purpose of home security, have purchased millions of automatic switches, manufactured by several major manufacturers. More specifically, for the purpose of simulating human activity in dwellings and other buildings to deter burglars when the occupants of the dwelling or building are away. Typical switches are clock operated. All of these clock-operated switches are settable to turn the light on or off, either on the hour or the half hour, two or more times in a 24-hour period. This practice of using a timer has become so widespread that it has become common knowledge that if the lights in a house switch on or off on the hour or the half hour, or at the same time on successive nights, that this is an indication that the owners are away and the house is unoccupied, indicating that a timer is being used to simulate occupancy. Even the popular movie of the late 1990's, entitled "Home Alone" has as a theme, the burglars who checked the time that the lights came on to determine that the owners were away on vacation.

The predictability of the timing of these devices has rendered them virtually counter-productive as burglar deterrents, as they now serve as much to inform the burglars of the absence of the occupants. In addition to the electromechanical clock types described, solid-state equivalent units are also available, also having the same inadequacies as the electromechanical types, for the purpose intended.

Notwithstanding their obsolescence as effective burglar deterrents due to their well known predictability, still they are continuously sold in all department stores, hardware stores, chain stores, discount stores and variety stores throughout North America, because no preferred alternative has been made available. It is the purpose of this invention therefore, to make available such alternative to better fill the need.

All clock operated timers and also the solid-state equivalent types, have three functional inadequacies, which prevent them from being effective burglar deterrents. First, they are precisely predictable, because they operate at the same times, day after day. Second, they are vulnerable to power interruptions, which gets them "off-schedule" until manually reset by the owner, who may be away for days or weeks, or in the case of a vacation home, they can be off-schedule for months. Third, the setting of time of day, and programming the turning on and off of the lights is time consuming, complicated, and bothersome.

The present invention overcomes all three of the above inadequacies, as will be explained herein below. The present invention described herein controls the lights in a way that is completely unrelated to horological time. The present invention will never, or very rarely if ever, turn its load on or off at the same time as the previous day. The present invention is so unlikely to turn its load on or off at the same time as the previous day, that it is estimated by probability at one chance in approximately 500,000.

Second, because the present invention has no relationship to the horological clock, and has no horological schedule. Therefore, after a power interruption, and when the power is restored, the present invention continues turning its load on and off at intervals unrelated to horological timing, and therefore continues to serve the intended purpose just as effectively as if the power interruption had not occurred. Third, the present invention eliminates the need for any setting of time of day and time-of-operation programming. In contrast, a single switch, set to "security" position in an instant, is all that is needed to enable the invention to function for its intended purpose.

The invention herein described is designed to be useful in three different embodiments as herein below described. In its basic simplest form, the user simply turns this invention on or off by a single manual switch. The invention may also be combined with a photoelectric sensor, which is well known in the art. In this embodiment the invention functions during the night, but not during the day. The invention may also be combined with a clock-operated switch, well known in the art, so as to function within selected hours only. In all three of the above embodiments the invention can be configured to plug directly into the wall outlet of the home, or fitted with a power cord and plug, and placed on any convenient table. It is available, therefore, as either "wall models" or "table models" for the convenience and preference of the user.

It is recognized, that the switching on and off of lamps, radios, and the like by electromechanical or electro-thermal means, as well as the timing of such switching, can be duplicated by solid state electronic means, using integrated circuits, triacs and other solid-state components. The duplication of the results of the invention by solid-state electronic means should be considered as the use of the present invention.

SUMMARY OF THE INVENTION

In view of the foregoing disadvantages inherent in the known types of security switches this invention provides an improved thermally activated security switch. As such, the present invention's general purpose is to provide a new and improved security switch that will operate independently from horological time.

The present invention is a thermally activated device for the simulation of human activity in an unoccupied dwelling. In its most basic embodiment, the invention utilizes a thermally sensitive switch, which when in use is electrically connected to a standard household electrical receptacle. Two heat sources are adjacent the switch, a primary and secondary resistor. Secondary resistor is connected to the electrical source in a parallel relation to the switch, while the primary, and significantly larger, resistor is in series in relation to the switch, so that it is activated only when the switch is closed. Both resistors and the switch are housed in a thermally insulating switch housing, which is in turn housed within an exterior housing. Exterior housing features an electrical receptacle, an electrical interface and a primary bypass switch, allowing a user to bypass the thermal switch and maintain a continuous electrical current between the interface and receptacle.

In use, the device is plugged into a receptacle and a load, such as a lamp or television set, is plugged into the device's receptacle. For everyday use, the primary switch is left in a continuous "on" position, electrically bypassing the thermal switch. For security use, the primary bypass switch directs current to the thermal switch. Usually, the thermal switch is closed, but as the resistors raise the surrounding temperature in the thermally insulated housing, the thermal switch is opened. The surrounding temperature drops slowly as secondary resistor is still providing heat and the thermally insulated housing slows heat transfer away from the switch. Eventually, the temperature cools to the point that the thermal switch again closes and allows current through.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

Figure 1:
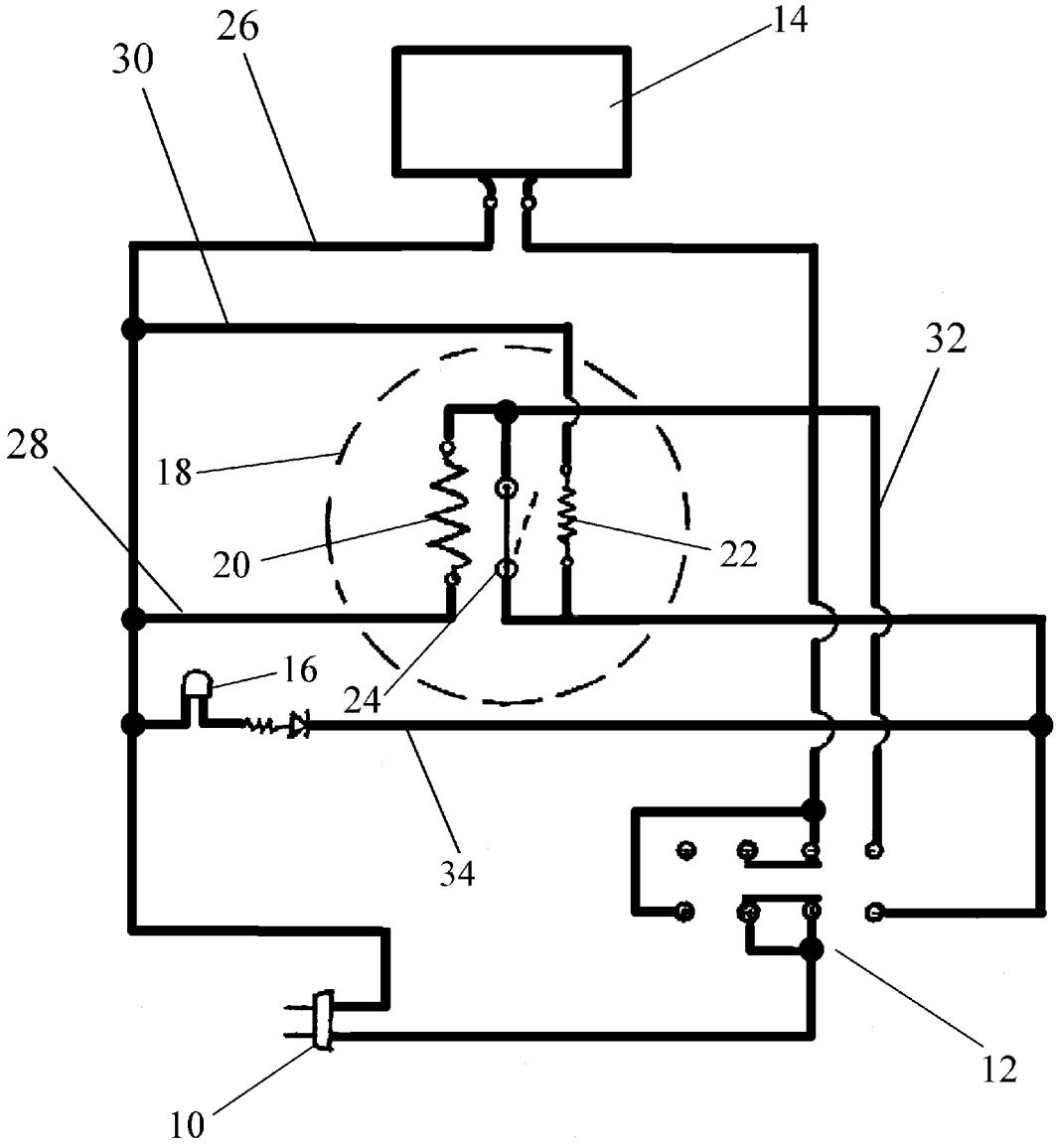
FIG. 1 is a circuit diagram of the present invention in open mode.

With reference now to the drawings, and with note that as used in this specification and the appended claims, the singular forms "a," "an," and "the" include plural referents unless the content clearly dictates otherwise, a preferred embodiment of the security switch is herein explained. As seen in FIG. 1, the switch, in its preferred embodiment, consists of three parallel circuits; all connected to a three-position manual control switch 12, usually a Three Throw-Double Pole type, and power supply 10. Continuous load circuit 26 is completed when switch 12 is in the continuously "on" position, shown in FIG. 2. In FIG. 3, the switch 12 is set on security mode, activating the indicator circuit 34, with LED 16, secondary heat circuit 30 and security circuit 28. Secondary heat circuit 30 is a continuous circuit with small resistor 22 providing a constant heat source. Security circuit 28 contains a large resistor 20, both acting as a primary heat source and having a smaller resistance than resistor 22, and thermally sensitive switch 24, which is normally closed. Resistance ratios are ideally that resistor 22 should have 10 to 15 times the resistance of resistor 20. In the preferred embodiment, Resistor 20 has a resistance of 6,200 ohms and resistor 22 has a resistance of 75,000 ohms. Control circuit 32 connects security circuit 28 to load circuit 26 in series between the power supply 10 and switch 24, ideally within enclosure 18 which contains both resistors 20, 22 and the switch 24.

Figure 2:
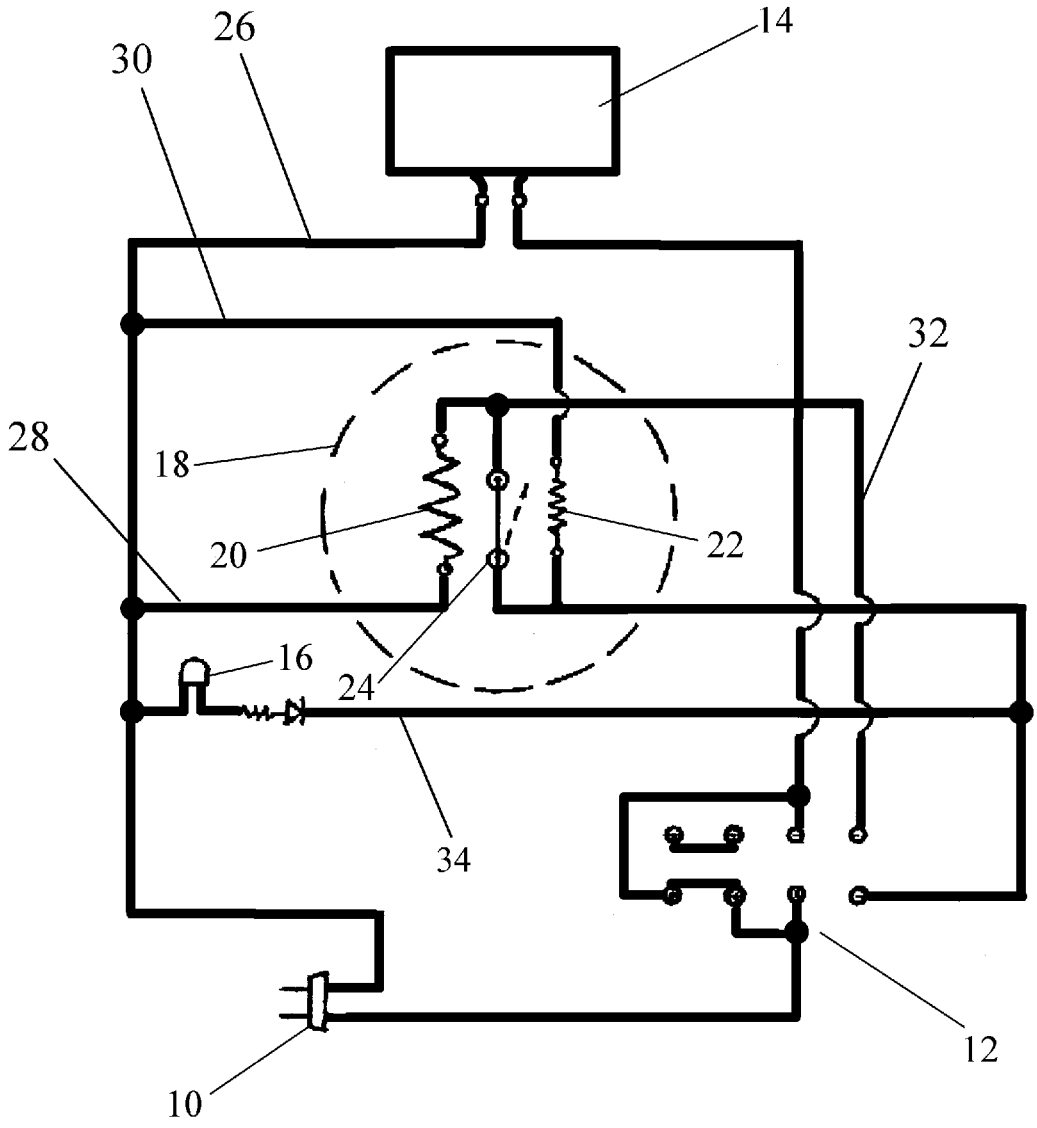
FIG. 2 is a circuit diagram of the present invention in continuous mode.
Figure 3:
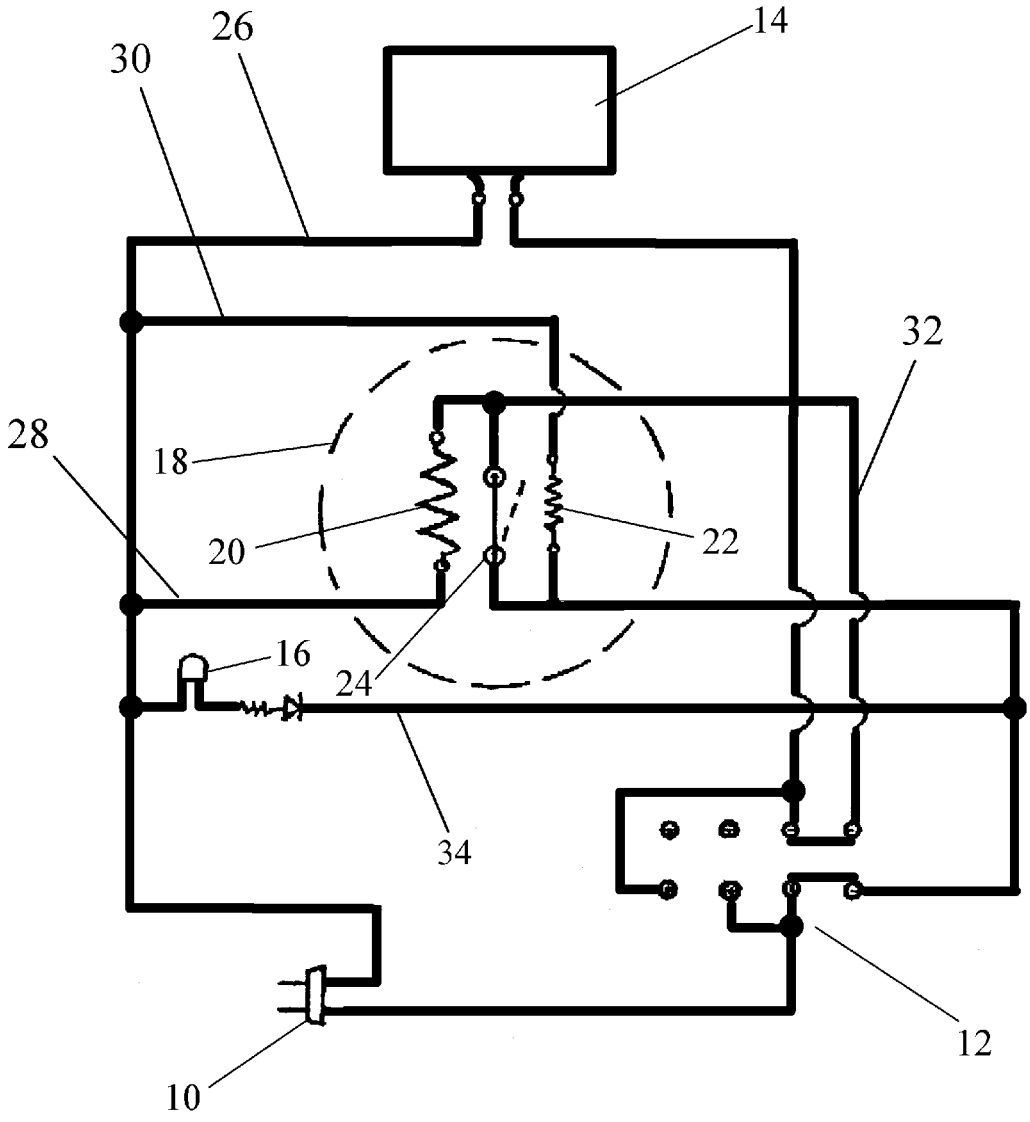
FIG. 3 is a circuit diagram of the present invention in security mode.

Referring to FIG. 2, the output load 14 would usually be a lamp, radio, or TV. With manual control switch 12 in the continuous position, the security circuit is bypassed so that power to the output load 14 is continuous. In FIG. 3, "Security" mode, input power is supplied to the output load 14 and to resistors 20 and 22. Resistors 20 and 22 slowly heat thermally sensitive switch 24, causing switch 24 to open, after a delay of over 15 minutes, turning off the output load 14 and resistor 20. Secondary resistor 22 remains energized to slow the cooling of thermally sensitive switch 24, which cools gradually until switch 24 closes again, repeating the periodic on-off cycles again and again until manual switch 12 is set to "Continuous" or "Off" by the user. Enclosure 18 isolates switch and resistors 20, 22 from the exterior environment, further ensuring that the cooling process is slowed down. Likewise, an external casing, enclosing the entirety of device components, further insulates the thermal switch 24 and resistors 20, 22.

Optional thermal mass, or heat sink, including the material from which enclosure 18 is manufactured, added inside the enclosure of the timing module can be applied to slow both the heating cycle and the cooling cycle. The optional thermal mass can be the addition of any thermally conductive material, such as by inserting epoxy resin into the thermal module, or by the addition of a thick steel disc inserted inside the enclosure 18 on top of the thermally sensitive switch 24.

Figure 4:
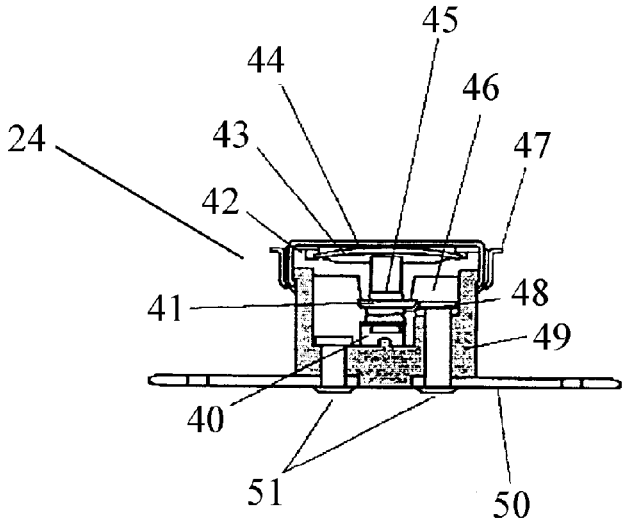
FIG. 4 is a cross sectional view of the thermally sensitive switch utilized in the invention in the open position.

The switch is activated by a bimetal disc 43 opening and closing the connection between the electrical contacts 48 in the switch 24, shown in FIG. 4. Switch 24 comprises a movable arm 41, held in place by retainer 46 and having additional contacts 48, and a stationary arm 40. The movable arm 41 operably connected to an actuating pin 45, which is moved by the contortions of bimetal disc 43. Bimetal disc 43 inherently has two metals with different expansion rates and thermal conductivity. Bimetal disc 43 is ideally made of brass and steel, though any combination of metals will suffice yielding different coefficients of thermal expansion and, therefore, varying thermal cycles. As such, one metal will expand more than the other, thus bending the disc 43 and moving the actuating pin 45 so that movable arm 41 connects and disconnects contacts 48, opening and closing the circuit. In FIG. 4, Switch 24 is in the open position, as seen by the bulging bimetal disc 43 and slight open space (unnumbered) between movable arm 41 and contact 48. In this embodiment of the switch 24, the more expansive side of the bimetal disc 43 (ideally brass) is upward. However, the arrangement of the bimetal disc 43 in relation to the remainder of the switch 24 is dependant upon the arrangement of the remainder of the switch (i.e. the disc 43 may push the switch 24 open rather than pull it as shown) and will not remove the new configuration from the scope of the invention. Ideally, spacer 42 is provided to allow room for disc contortion and a sensing cap 44 closely covers the disc 43, allowing for thermal interaction, and the rest of the switch assembly in case 49. Also ideally, case 49 is riveted 51 to a terminal backing 50.

Numerous additions may be made to the invention to increase utility. A timer override switch, common in the prior art, could be added as an override, preventing the switch 24 from actuating during inappropriate times. Likewise, a photoelectric resistor may be added for similar effect. Both of these devices are known in the prior art.

Although the present invention has been described with reference to preferred embodiments, numerous modifications and variations can be made and still the result will come within the scope of the invention. As an example, solid-state circuitry may be used to achieve the same effect as the resistors and other circuitry in this disclosure. No limitation with respect to the specific embodiments disclosed herein is intended or should be inferred.

What is claimed is:

1. A thermally sensitive electrical security device comprising:

a. a thermally sensitive switch, capable of both opening and closing repeatedly responsive to temperature within at least one thermal isolation chamber;

b. at least one primary heater, the switch and primary heater being electrically coupled in series;

c. a secondary, lower temperature heater that is continually connected to a power connection means;

d. an output load receptacle, coupled in series with the switch and the at least one primary heater, for connection to a load providing a security output function; and wherein the switch, the at least one primary heater and the secondary heater are located within the at least one thermal isolation chamber;

wherein the switch, the at least one primary heater, and the output load receptacle are electrically connected so that when the device is powered through the power connection means, the switch is being heated by the at least one primary heater and the secondary heater to reach a first given temperature, the switch opens, and then closes at a second lower given temperature after a time period determined by heat transfer between the at least one thermal isolation chamber and the environment, thereby preventing and allowing respectively powering of the output load receptacle to power the security output function by generating a variable time switching of the load.

2. The security device of claim 1, wherein the heaters are resistors.

3. The security device of claim 2, wherein the secondary heater is a resistor of greater resistance than the primary heater.

4. The security device of claim 1, further comprising a photosensitive resistor, said photosensitive resistor being in series connection with the primary heater such that when the photosensitive resistor detects light its resistance increases.

5. The security device of claim 1, further comprising a timer.

6. The security device of claim 1, further comprising a heat sink.

7. The security device of claim 1, the device utilizing solid-state circuitry.

8. The security device of claim 7, further comprising a heat sink.

9. A thermally sensitive electrical security device comprising:

a. a primary activation switch having at least three positions;

b. an output load, electrically connected such that power is supplied to the output load continuously when the primary switch is in a first position;

c. a thermally sensitive switch within at least one thermal isolation chamber and operably connected in series to the output load when the primary switch is in a second position, wherein the thermally sensitive switch is capable of both opening and closing repeatedly responsive to temperature within the at least one thermal isolation chamber;

d. at least one primary heater, also connected in series with the thermally sensitive switch and the output load;

e. a secondary, lower temperature heater that is continually connected to a power connection means when the primary switch is in the second position; and f. an output load receptacle, coupled in series with the switch and the at least one primary heater, for connection to the output load providing a security output function when the primary activation switch is in the second position;

wherein the switch, the at least one primary heater and the secondary heater are located within the at least one thermal isolation chamber;

wherein the thermally sensitive switch, the at least one primary heater, and the output load are electrically connected in series so that when the primary switch is in the second position and device is powered through the power connection means, the thermally sensitive switch is being heated by the at least one primary heater and the secondary heater to reach a first given temperature, the switch opens, and then closes when cooled at a second lower given temperature after a time period determined by heat transfer between the at least one thermal isolation chamber and the environment, thereby opening and closing the circuit to the output load to provide the security output function by generating a variable time switching of the load.

10. The security device of claim 9, both heaters being resistors.

11. The security device of claim 10, wherein the secondary heater is a resistor of greater resistance than the primary heater.

12. The security device of claim 9 further comprising an indicator that is activated when the primary activation switch is in the second position.

13. The security device of claim 9, further comprising a heat sink.

14. The security device of claim 9, further comprising a timer.

15. The security device of claim 9, further comprising a photosensitive resistor, said photosensitive resistor being in series connection with the primary heater such that when the photosensitive resistor detects light its resistance increases and closes the circuit to the primary heater.

16. The security device of claim 9, the device utilizing solid-state circuitry.

* * * * *